US011121517B2

(12) United States Patent
Mabuchi et al.

(10) Patent No.: US 11,121,517 B2
(45) Date of Patent: Sep. 14, 2021

(54) CORE WIRE DEFORMATION JIG AND CORE WIRE DEFORMATION METHOD

(71) Applicant: Yazaki Corporation, Tokyo (JP)

(72) Inventors: Miyoshi Mabuchi, Makinohara (JP); Kohsuke Okazaki, Makinohara (JP); Kousuke Masuda, Makinohara (JP); Tomoyuki Oohira, Nagano (JP)

(73) Assignee: YAZAKI CORPORATION, Tokyo (JP)

( * ) Notice: Subject to any disclaimer, the term of this patent is extended or adjusted under 35 U.S.C. 154(b) by 139 days.

(21) Appl. No.: 16/578,617

(22) Filed: Sep. 23, 2019

(65) Prior Publication Data

US 2020/0136334 A1 Apr. 30, 2020

(30) Foreign Application Priority Data

Oct. 24, 2018 (JP) ..... JP2018-199758

(51) Int. Cl.
*H01R 43/28* (2006.01)

(52) U.S. Cl.
CPC ..... *H01R 43/28* (2013.01); *Y10T 29/49174* (2015.01); *Y10T 29/53217* (2015.01)

(58) Field of Classification Search
CPC ..... H01R 43/28; H02G 1/14
See application file for complete search history.

(56) References Cited

U.S. PATENT DOCUMENTS

| | | | | | |
|---|---|---|---|---|---|
| 4,183,383 | A * | 1/1980 | Gudmestad | ..... | H01R 43/28 140/105 |
| 4,247,980 | A * | 2/1981 | Tominoi | ..... | H01R 43/04 29/742 |
| 4,476,628 | A * | 10/1984 | Kees, Jr. | ..... | H01R 43/01 29/861 |
| 5,465,478 | A * | 11/1995 | Anderson | ..... | H01R 43/28 242/443 |
| 2014/0366370 | A1* | 12/2014 | Takasaki | ..... | H01R 43/28 29/857 |
| 2020/0079612 | A1* | 3/2020 | Kinoshita | ..... | D07B 7/10 |

FOREIGN PATENT DOCUMENTS

| | | | | | |
|---|---|---|---|---|---|
| CN | 206116853 | U | 4/2017 | | |
| DE | 102016003958 | A1 * | 10/2016 | ..... | H01R 43/28 |
| JP | 06-231853 | A | 8/1994 | | |
| JP | 2018185917 | A | 11/2018 | | |

* cited by examiner

*Primary Examiner* — Michael C Zarroli
(74) *Attorney, Agent, or Firm* — Sughrue Mion, PLLC

(57) ABSTRACT

A core wire deformation jig and a method for deforming a plurality of core wires which are exposed from an end of a multi-core cable for a further working step. The jig includes a first clamping unit for clamping the core wires aligned on the arranging plane in a first clamping direction intersecting the arranging plane, a separation pin for separating the core wires, wherein the separation pin is inserted between the core wires in a insertion direction parallel to the first clamping direction, and a second clamping unit for providing bends to the core wires by clamping the core wires in a second clamping direction parallel to the arranging plane and intersecting the plurality of core wires and applying a pressure on the core wires, with the separation pin inserted between the core wires.

6 Claims, 7 Drawing Sheets

CORE WIRE DEFORMATION JIG AND CORE WIRE DEFORMATION METHOD

BACKGROUND OF THE INVENTION

Technical Field

The present invention relates to a core wire deformation jig for deforming a plurality of core wires which are exposed from an end of a multi-core cable.

Background Art

Until now, a technique with a further working step has been proposed which is carried out after adjusting a holding distance for a plurality of electric wires held one by one so that they are spaced and aligned at the predetermined distance, e.g. crimping together of their terminals (see e.g. Patent Document 1). Since the holding distance for a plurality of electric wires held one by one according to this technique is adjustable, it is possible to align them spaced at a predetermined distance even if the electric wires have different thicknesses.

CITATION LIST

Patent Literature

Patent Document 1: JP H 06-231853 A1

SUMMARY OF THE INVENTION

Here, the plurality of electric wires used for the working step may be a plurality of core wires which are exposed from an end of a multi-core cable. In this case, many of the core wires are exposed, being in tight contact with each other tightly, wherein the above mentioned technique suffers the problem that it is difficult to apply this technique to such core wires since it is difficult to hold the core wires one by one. Consequently, an operating person currently needs to spread the core wires in tight contact one by one in a manual manner and set them in an equipment. Such a setting operation is very complicated, and for a plurality of core wires in tight contact which are exposed from an end of a multi-core cable, there is a need for a jig and a method for deforming them spread out in order to more easily perform the further working step.

In view of the above mentioned problem, the objective of the present invention is therefore to provide a core wire deformation jig and a method for deforming a plurality of core wires which are exposed from an end of a multi-core cable for a further working step.

In order to achieve the above objective, a core wire deformation jig according to the present invention is provided which provides bends to a plurality of core wires which is exposed from an end of a multi-core cable so that tip side portions of the core wires are spaced and aligned on a predetermined arranging plane, the bends with the core wires being spread out starting from root sides of their exposed portions to the tip side portions, the core wire deformation jig comprising: a first clamping unit for clamping the plurality of core wires aligned on the arranging plane in a first clamping direction intersecting the arranging plane; a separation pin for separating the plurality of core wires from each other, the separation pin being inserted between the plurality of core wires clamped by the first clamping unit in an insertion direction parallel to the first clamping direction; and a second clamping unit for providing the bends to the plurality of core wires by clamping the plurality of core wires in a second clamping direction parallel to the arranging plane and intersecting the plurality of core wires and applying a pressure on the core wires, with the separation pin inserted between the plurality of core wires.

Furthermore, in order to achieve the above objective, a core wire deformation method according to the present invention is provided which provides bends to a plurality of core wires which is exposed from an end of a multi-core cable so that tip side portions of the core wires are spaced and aligned on a predetermined arranging plane, the bends with the core wires being spread out starting from root sides of their exposed portions to the tip side portions, the core wire deformation method including: a first clamping step for clamping with a first clamping unit the plurality of core wires aligned on the arranging plane in a first clamping direction intersecting the arranging plane; a separation step for separating the plurality of core wires from each other, the separation pin being inserted between the plurality of core wires clamped with the first clamping unit in an insertion direction parallel to the first clamping direction; and a second clamping step for providing the bends to the plurality of core wires by clamping the plurality of core wires with a second clamping unit, with the separation pin inserted between the plurality of core wires, in a second clamping direction parallel to the arranging plane and intersecting the plurality of core wires and applying a pressure on the core wires.

According to the core wire deformation jig and method of the present invention, the plurality of core wires are separated by the separation pin so as to be spaced from each other, wherein the plurality of core wires are clamped by the first and second clamping units in two directions. With this, bends which spread out the plurality of core wires can be provided to the plurality of core wires which are exposed from an end of the multi-core cable. By providing such bends, it is not necessary to perform complicated operations such as one-by-one spreading of core wires in tight contact for a further working step. In this manner, the core wire deformation jig and method according to the present invention can deform a plurality of core wires exposed from an end of a multi-core cable for a further working step.

DETAILED DESCRIPTION OF THE PREFERRED EMBODIMENTS

Now, an embodiment of the present invention shall be described.

Figure 1:
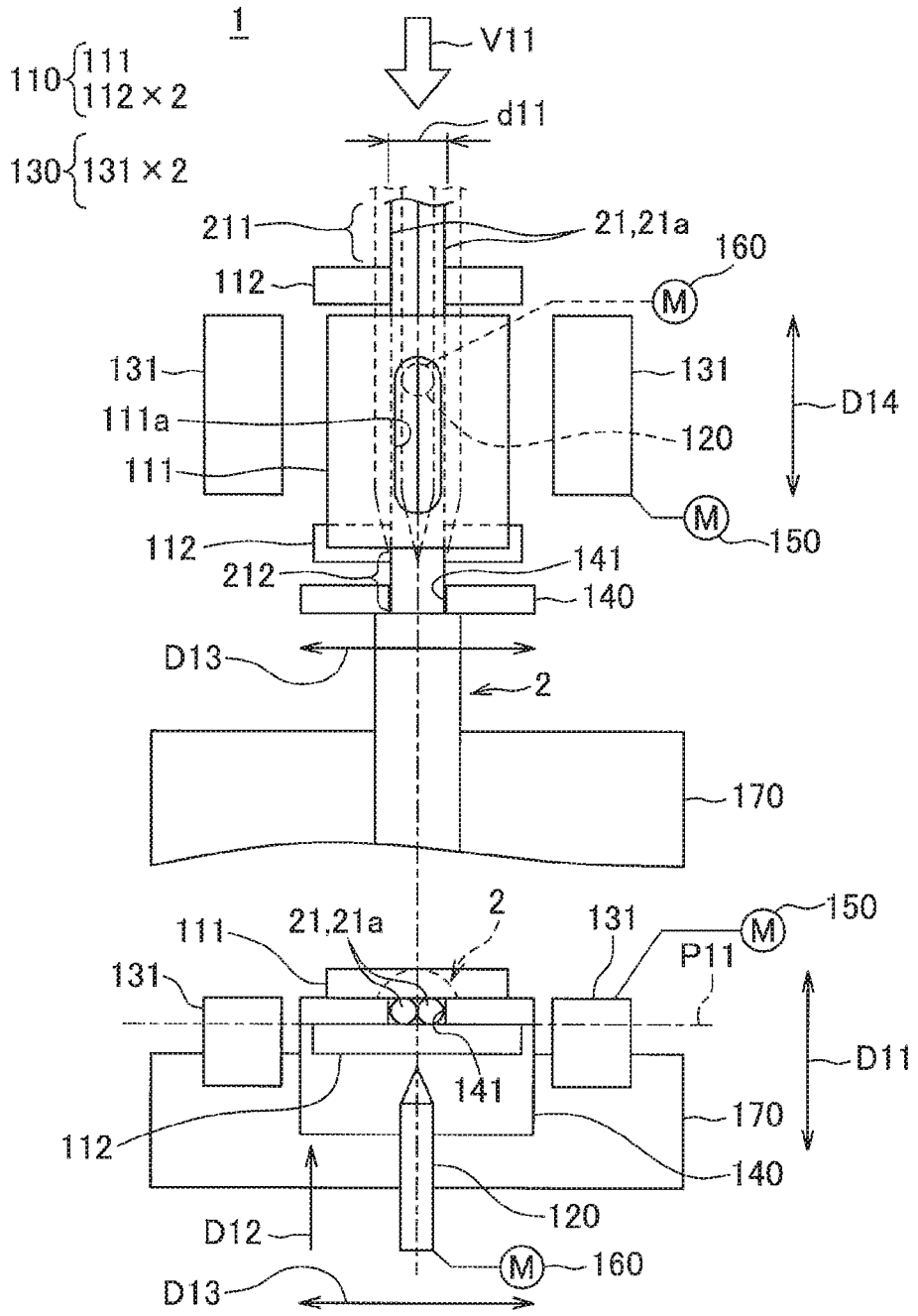
FIG. 1. is a schematic diagram showing a core wire deformation jig according to an embodiment of the present invention.

FIG. 1 is a schematic diagram showing a core wire deformation jig according to an embodiment of the present invention. This FIG. 1 shows a core wire deformation jig 1 in a top view seen onto an arranging plane P11 of two core wires 21 exposed from an end of a multi-core cable 2, and in a side view in a direction indicated by an arrow V11 as shown.

The core wire deformation jig 1 is a device which provides bends to the two core wires 21 exposed from the end of the multi-core cable 2, wherein the bends spread them out as indicated by dash lines in the Figure. These bends are provided by deformation for spreading out starting from root sides 212 of exposed portions 21*a* to tip side portions 211 of the core wires 21 so that the tip side portions 211 are spaced and aligned on the arranging plane P11 at a distance d11 which is predetermined depending on a further working step.

The core wire deformation jig 1 includes a first clamping unit 110, a separation pin 120, a second clamping unit 130, a third clamping unit 140, a second clamping unit actuating mechanism 150, a separation pin actuating mechanism 160 and a cable table 170.

The first clamping unit 110 is a section which clamps the two core wires 21 aligned on the arranging plane P11 in a first clamping direction D11 which intersects the arranging plane P11. This first clamping unit 110 includes one rectangular-plate-shaped upper clamping portion 111 and two rectangular-bar-shaped lower clamping portions 112. The upper clamping portion 111 is a portion which covers the core wires 21 so that they do not escape upwards when the separation pin 120 is inserted between the core wires 21. The upper clamping portion 111 includes an elongated through-hole 111*a* through which a tip portion of the inserted separation pin 120 is inserted movably in a movement direction D14 as described below. The two lower clamping portions 112 are portions which supports the core wires 21 from downwards so that they may not be bent downwards when the inserted separation pin 120 moves in the movement direction D14 toward the root sides 212 of the exposed portions 21*a*. The two lower clamping portions 112 are arranged intersecting the core wires 21 at a location closer to the tip side portions 211 of the exposed portions 21*a* and at a location closer to the root sides 212 respectively in a manner that does not disturb movement of the separation pin 120. The upper clamping portion 111 is arranged facing the arranging plane P11, clamping the core wires 21 between the upper clamping portion 111 and the arranging plane P11. Furthermore, the two lower clamping portions 112 are arranged so that each of their upper faces coincides with the arranging plane P11 and supports the core wires 21 from downwards.

The separation pin 120 is a portion which is inserted in a insertion direction D12 parallel to the first clamping direction D11 between the two core wires 21 clamped by the first clamping unit 110 and separates the two core wires 21 so that they are spaced at a predetermined distance d11 from each other. The separation pin 120 has a round-bar shape with a cone-formed tip.

And the separation pin 120 is provided movably in a movement direction D14 parallel to the arranging plane P11 and intersecting the second clamping direction D13.

The above mentioned through hole 111*a* of the upper clamping portion 111 is configured as an elongated hole with a width which is some larger than a diameter of the separation pin 120 so as to enable movement of this separation pin 120.

The second clamping unit 130 is a section which clamp, in a second clamping direction D13 parallel to the arranging plane P11 and intersecting the two core wires 21, the two core wires 21 with the separation pin 120 inserted and apply a pressure on them to provide the above mentioned bends to these two core wires 21. The second clamping unit 130 includes two left and right rectangular-block-shaped clamping portions 131 which are arranged so as to extend in a length direction of the core wires 21. The second clamping unit 130 clamps and apply a pressure on the two core wires 21 by clamping them between opposing side faces of the two left and right clamping portions 131.

The third clamping unit 140 is a section with a rectangular-plate shape which clamps the root sides 212 of the exposed portions 21*a* in the two core wires 21 in the second clamping direction D13 while being in tight contact with each other. The third clamping unit 140 is arranged so as to extend intersecting the two core wires 21 as well as their arranging plane P11. A rectangular clamping groove 141 which accommodates and clamps the two core wires 21 in tight contact is provided at an upper edge of the third clamping unit 140.

The second clamping unit actuating mechanism 150 is an actuator which actuates the left and right clamping portions 131 of the second clamping unit 130 in the second clamping direction D13 so as to bring them close to or away from each other. In this case, the present embodiment is configured to stop the left and right clamping portions 131 at appropriate positions depending on thicknesses of the two core wires 21 etc. so that no excessive load may be applied when the left and right clamping portions 131 are brought close to each other to clamp and apply a pressure on the two core wires 21. The second clamping unit actuating mechanism 150 is a position-controlled actuator which allows such a stop depending on the thickness etc., or an actuator which can define stop positions at a plurality of locations depending on the thickness etc.

The separation pin actuating mechanism 160 is an actuator which inserts the separation pin 120 between the two core wires 21 at a location far from the root sides 212 of the exposed portions 21*a* and moves them after the insertion toward the root sides 212 of the exposed portions 21*a*. The separation pin actuating mechanism 160 moves the separation pin 120 in the insertion direction D12 between the retracted position and the insertion position and in the movement direction D14 between the insertion position far from the root sides 212 and a pulling position at which the separation pin 120 is pulled toward the root sides 212. Furthermore, the insertion position in the insertion direction D12 and the pulling position in the movement direction D14 are predetermined depending on the thicknesses of the core wires 21 etc. The separation pin actuating mechanism 160 is a position-controlled actuator which allows such a stop at the insertion position or at the pulling position depending on the thickness, or an actuator which can define stop positions at a plurality of locations depending on the thickness etc.

The cable table 170 is a table on which the multi-core cable 2 is put and fixed which is subject to deformation of its core wires 21 by the above described elements. On the cable table 170, the multi-core cable 2 is held and fixed with a pose in which the root sides 212 of the exposed portions 21*a* of the two core wires 21 are aligned on the arranging plane P11.

Next, a core wire deformation method is described which is carried out using the core wire deformation jig 1 as described above.

Figure 2:
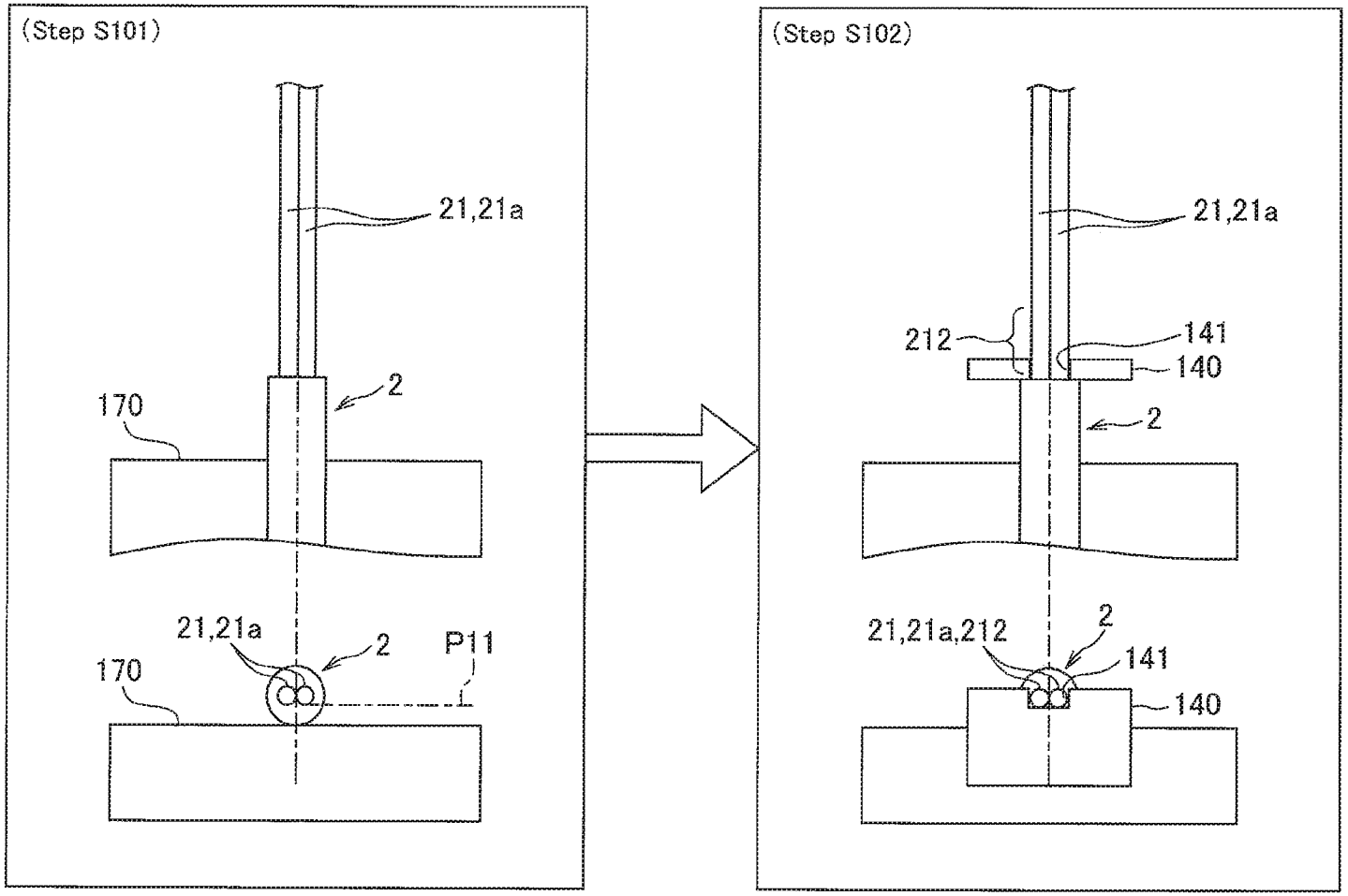
FIG. 2. is a schematic diagram showing processes at steps S101 and S102 within a core wire deformation method which is carried out using the core wire deformation jig according to FIG. 1.

FIG. 2 is a schematic diagram showing processes at steps S101 and S102 within a core wire deformation method which is carried out using the core wire deformation jig according to FIG. 1.

First, the multi-core cable 2 is revolved on its axis at the step S101 on the cable table 170 to be adjusted so that the exposed portions 21*a* of the two core wires 21 take a pose in which they are aligned on the arranging plane P11. Once the pose is established, the multi-core cable 2 is held and fixed on the cable table 170.

At the step S102, the third clamping unit 140 is attached to these root sides 212 so as to bring the root sides 212 of the exposed portions 21*a* into tight contact with each other which are included within the two core wires 21. This third clamping unit 140 brings the core wires 21 close to each other loosely so as to accommodate them in the rectangular clamping groove 141 and bring them into close contact with each other. In this way, a load applied on the core wires 21 in the exposed portions 21*a* during deformation can be prohibited from extending to internal core wires in a sheath in a non-exposed portion of the multi-core cable 2.

Figure 3:
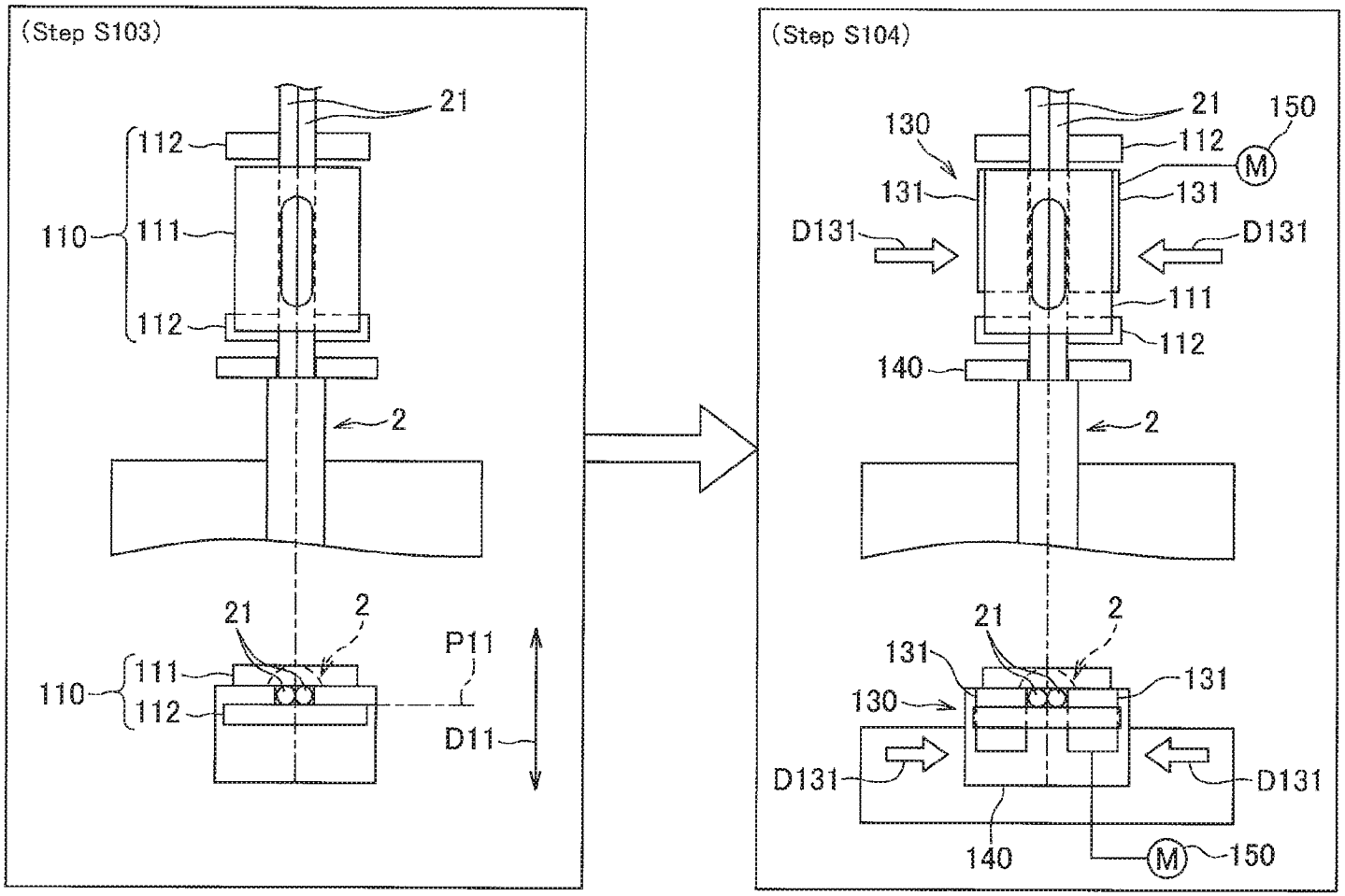
FIG. 3. is a schematic diagram showing processes at steps S103 and S104 within the core wire deformation method.

FIG. 3 is a schematic diagram showing processes at steps S103 and S104 within the core wire deformation method.

At the step S103, the upper clamping portion 111 and the two lower clamping portions 112 of the first clamping unit 110 is attached, wherein the core wires 21 of the multi-core cable 2 aligned on the arranging plane P11 are clamped loosely in the first clamping direction D11. The process of this step S103 corresponds to the first clamping step for clamping the two core wires 21 aligned on the arranging plane P11 with the first clamping unit 110 in the first clamping direction D11 intersecting the arranging plane P11.

At the step S104, the second clamping unit actuating mechanism 150 moves, in a direction of an arrow D131 to a predetermined position, the left and right clamping portions 131 of the second clamping unit 130 that have been retracted to a position which does not disturb attachment of the third clamping unit 140, the upper clamping portion 111 and the lower clamping portions 112. This movement causes that the two core wires 21 are clamped and pulled by the left and right clamping portions 131 toward a center to the extent that they come into tight contact with each other but not compressed.

Figure 4:
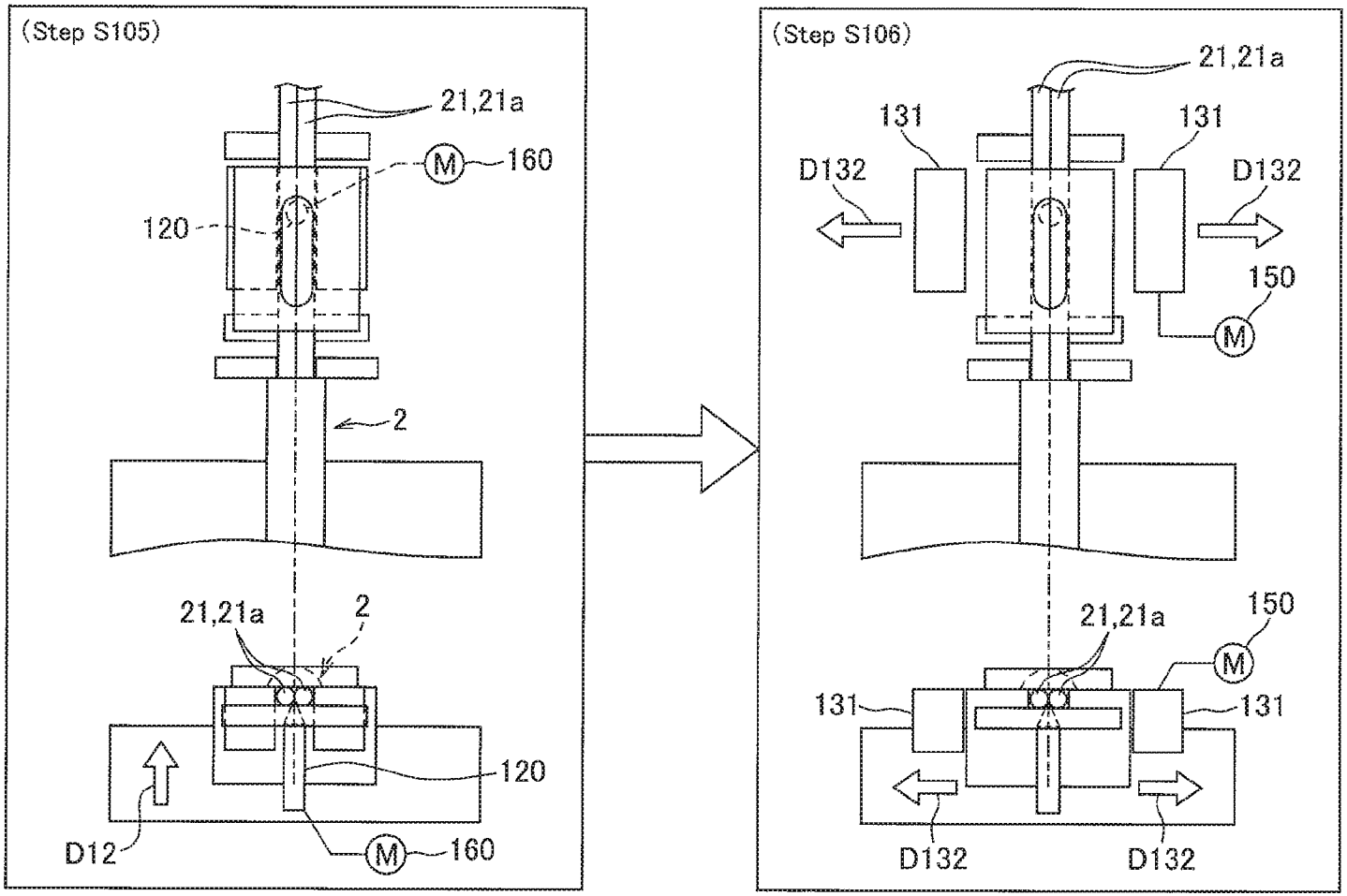
FIG. 4. is a schematic diagram showing processes at steps S105 and S106 within the core wire deformation method.

FIG. 4 is a schematic diagram showing processes at steps S105 and S106 within the core wire deformation method.

At the step S105, the separation pin actuating mechanism 160 inserts the separation pin 120 in the insertion direction D12 between the two core wires 21 pulled toward the center in the exposed portions 21*a* to the extent that the tip of the separation pin 120 reaches the middle in a thickness direction of the core wires 21.

At the step S106, the second clamping unit actuating mechanism 150 retracts the left and right clamping portions 131 in a direction of arrows D132 so that the exposed portions 21*a* of the core wires 21 may not be compressed even if the separation pin 120 is further inserted.

Figure 5:
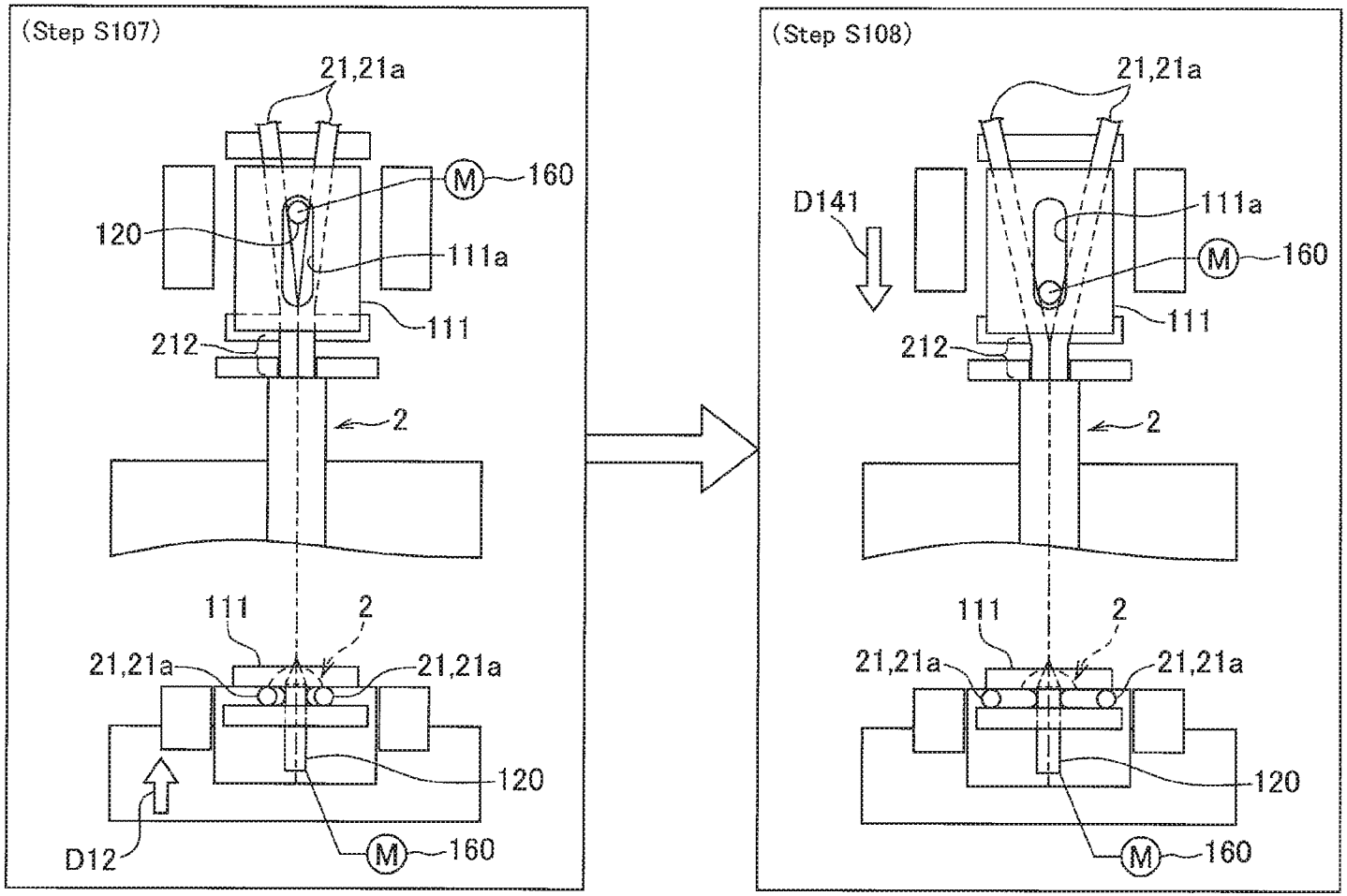
FIG. 5. is a schematic diagram showing processes at steps S107 and S108 within the core wire deformation method.

FIG. 5 is a schematic diagram showing processes at steps S107 and S108 within the core wire deformation method.

At the step S107, the separation pin actuating mechanism 160 inserts the separation pin 120 in the insertion direction D12 until it is inserted through the through hole 111*a* of the upper clamping portion 111 and the tip comes out of it. With this insertion, the exposed portions 21*a* of the two core wires 21 of the multi-core cable 2 are spread out in the left and right directions in a V-shape. Here, the insertion of the separation pin 120 until this stage is performed at an insertion point of the elongated through hole 111*a* which corresponds to an end far from the root sides 212 of the exposed portions 21*a*.

The process at the step S107 corresponds to the separation step for separating the two core wires 21 from each other, wherein the separation pin 120 is inserted between the two core wires 21 clamped by the first clamping unit 110 in the insertion direction D12 parallel to the first clamping direction D11.

At the step S108, the separation pin actuating mechanism 160 moves the separation pin 120 which has previously been at the above mentioned insertion point in an arrow D141 along the through hole 111*a* of the upper clamping portion 111 to the pulling position at the root sides 212 of the exposed portions 21*a*. Here, the pulling position in this case is predetermined according to the thicknesses of the core wires 21. The pulling movement of the separation pin 120 results in a further spreading of the two core wires 21 of the multi-core cable 2 in the exposed portions 21*a* in a V-shape in the right and left directions.

Figure 6:
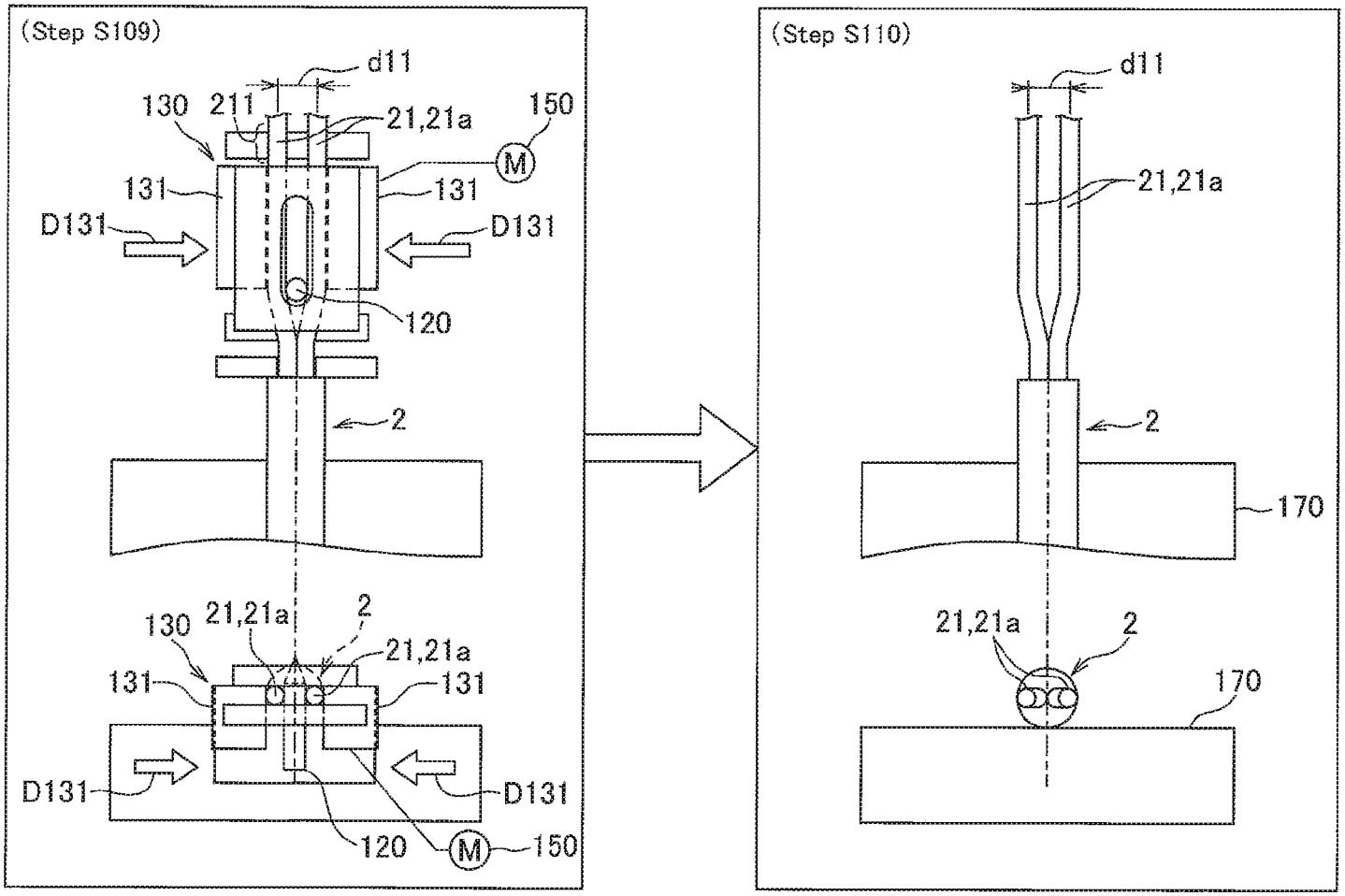
FIG. 6. is a schematic diagram showing processes at steps S109 and S110 within the core wire deformation method.

FIG. 6 is a schematic diagram showing processes at steps S109 and S110 within the core wire deformation method.

At the step S109, the second clamping unit actuating mechanism 150 brings the left and right clamping portions 131 of the second clamping unit 130 close to the two core wires 21 of the multi-core cable 2 which are spread out by the pulling movement of the separation pin 120, in a direction of an arrow D131. With such an approach of the left and right clamping portions 131, the two core wires 21 are clamped by the left and right clamping portions 131 to apply a pressure on the two core wires 21. And bends for spreading out starting from the root sides of the exposed portions 21*a* to the tip side portions 211 are provided so that the tip side portions 211 are spaced and aligned substantially in parallel to each other at the distance d11. How large the distance d11 between the tip side portions 211 is, it is previously determined by the thicknesses of the core wires 21 and/or a shape of a component which is attached to the core wires 21 in a further process etc.

The process at the step S109 corresponds to the second clamping step for providing the bends to the two core wires 21 by clamping the two core wires 21 with the second clamping unit 130 in the second clamping direction D13 parallel to the arranging plane P11 and intersecting the core wires 21 and applying a pressure on the core wires 21, with the separation pin 120 inserted between the two core wires 21.

At the step S110, the first clamping unit 110, the separation pin 120, the second clamping unit 130 and the third clamping unit 140 are removed from the periphery of the two core wires 21 of the multi-core cable 2 to which the bend have been provided by the previous processes until now. And the multi-core cable 2 with the bends provided to the core wires 21 is now removed from the cable table 170, with which the core wire deformation method according to the present embodiment ends.

With the core wire deformation jig 1 and the core wire deformation method according to the present embodiment as described above, the two core wires 21 are clamped in two directions by the first clamping unit 110 and the second clamping unit 130 while being separated from each other by the separation pin 120. In this way, the bends for spreading out can be provided to the two core wires 21 which are exposed from an end of the multi-core cable 2. By providing such bends, it is not necessary to perform complicated operations such as spreading out the core wires 21 in tight contact one by one in a manual manner for a further working step. In this way, the present embodiment enables deformation of the two core wires 21 exposed from an end of the multi-core cable 2 for a further working step.

Furthermore, according to the present embodiment, movement of the separation pin 120 which determines the distance d11 of the core wires 21 at the bends, and movement of the second clamping unit 130 are performed by an actuator such as the second clamping unit actuating mechanism 150 and the separation pin actuating mechanism 160. As a result, bends as described above can be provided iteratively in a highly reproducible manner. Furthermore, the pressure applied by clamping of the second clamping unit 130 at the time of providing the bends can be controlled by the second clamping unit actuating mechanism with a high accuracy. Therefore, situations such as damaging the core wires 21 due to an excessive pressure load can be avoided effectively.

According to the present embodiment, the third clamping unit 140 is provided which clamps the root sides 212 of the exposed portions 21*a* within the two core wires 21, with the root sides 212 in tight contact with each other, in the second clamping direction D13.

With the present embodiment, a load which is applied on the core wires 21 in the exposed portions 21*a* during deformation can be prohibited from extending to internal core wires in non-exposed portions of the multi-core cable 2 by the third clamping unit 140 which clamps the root sides 212 of the exposed portions 21*a* in tight contact with each other.

Furthermore, according to the present embodiment, the separation pin 120 is provided movably in the movement direction D14 parallel to the arranging plane P11 and intersecting the second clamping direction D13. And the separation pin actuating mechanism 160 is provided which inserts this separation pin 120 between the two core wires 21 into a position far from the root sides 212 of the exposed portions 21*a* and moves it toward the root sides of the exposed portions 21*a* after insertion.

With the present embodiment, it is possible to limit the deformation of the core wires 21 in the exposed portions 21*a* to the root sides 212 and to align the tip side portions 211 substantially in parallel. Such two core wires 21 with their tip side portions 211 aligned substantially in parallel are preferable since they can be used very easily for a further working step such as crimping the terminals or removing sheaths at once. Another reason why it is preferable is that the arranging distance for the tip side portions 211 can be adjusted by how far the separation pin 120 is moved toward the root sides 212.

Next, an example of variation to the embodiments described above shall be described.

Figure 7:
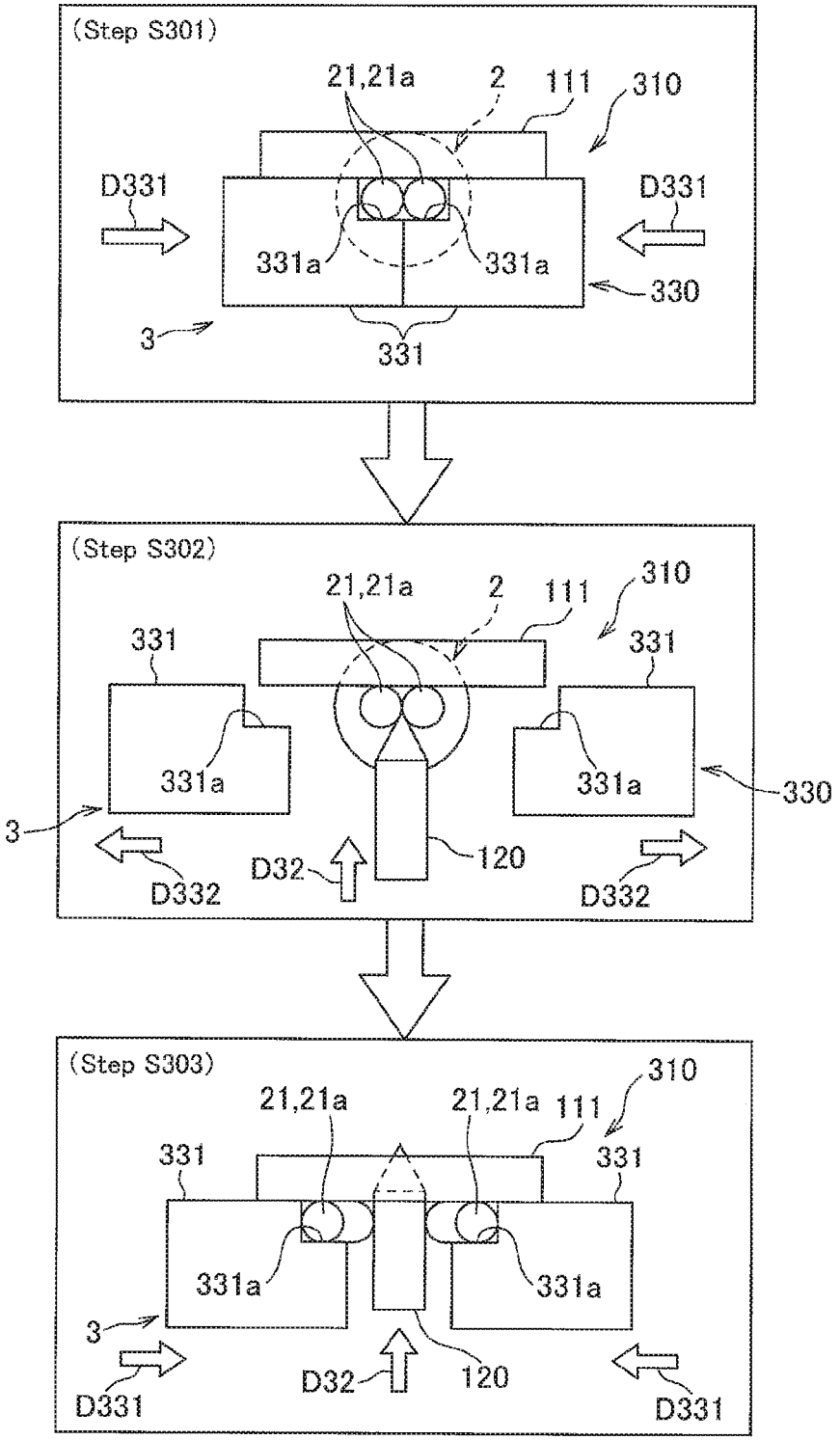
FIG. 7. is a schematic diagram showing an example of variation of the core wire deformation jig and method according to FIGS. 1-6.

FIG. 7 is a schematic diagram showing an example of variation of the core wire deformation jig and method according to FIGS. 1-6. It is to be noted that similar elements in this FIG. 7 to those of the core wire deformation jig 1 and the multi-core cable 2 to be deformed according to FIGS. 1-6 are labelled with the same reference signs as in FIGS. 1-6, wherein iterative description of these similar elements shall be omitted hereinafter.

According to this example of variation shown in FIG. 7, a core wire deformation jig 3 includes a second clamping unit 330 as an element by which the lower clamping portions 112 and the second clamping unit 130 in the core wire deformation jig 1 according to the above described embodiments.

The second clamping unit 330 according to the present embodiment also serves as the lower clamping portion 112 (see FIG. 1) corresponding to one of the pair of clamping portions of the first clamping unit 310. Here, the first clamping unit 310 includes an upper clamping portion 111 which is similar to that of the above described embodiments.

In each of a pair of left and right clamping portions 331 within the second clamping unit 330, steps 331*a* are formed at upper edges facing the respective other left or right clamping portions 331, wherein one of exposed portions 21*a* of the core wires 21 is arranged on each of the steps 331*a* and each of the steps 331*a* supports one of the exposed portions 21*a*.

In a core wire deformation method according to the example of variation shown in FIG. 7, following the steps S101 and S102 as shown in FIG. 2, the upper clamping portion 111 is first arranged onto the exposed portions 21*a* of the two core wires 21 of the multi-core cable 2 at the step S301. Then, the left and right clamping portions 331 are moved in a direction of an arrow D331 so that the core wires 21 are received on the respective steps 331*a*, wherein the two core wires 21 are clamped in two directions, i.e. in a vertical direction as well as in a horizontal direction, at the same time.

Next, at the step S302, the separation pin 120 is inserted in an insertion direction D32 to the extent that its tip reaches the middle in a thickness direction of the core wires 21 after the left and right clamping portions 331 have been retracted in a direction of an arrow D332 once.

At the following step S303, an insertion of the separation pin 120 in an insertion direction D32 is performed which is similar to the step 107 shown in FIG. 5. After this insertion, according to the present example of variation, the left and right clamping portions 331 are brought some closer in the direction of the arrow D331 prior to movement of the separation pin 120 which is similar to the step S108. At this time, each of the core wires 21 is supported from downwards by putting the exposed portions 21*a* on the steps 331*a* of the respective left and right clamping portions 331 so as not to be bent downwards when the separation pin 120 is moved. Once the movement of the separation pin 120 is ended, the left and right clamping portions 331 are brought still closer in the direction of the arrow D331 in order to clamp and apply a pressure on the two core wires 21 so that they are spaced at a predetermined distance d11. In this way, bends are provided in the two core wires 21.

Also with the example of variation of the core wire deformation jig 3 and the core wire deformation method as described above, it is evident that the two core wires 21 exposed from an end of the multi-core cable 2 can be deformed for a further working step in the same manner as in the previous embodiments.

According to the present example of variation, the second clamping unit 330 also serves as the lower clamping portions of the pair of clamping portions within the first clamping unit 310.

The present example of variation reduces an amount of components by the second clamping unit 330 which also serves as a part of the first clamping unit 310, which can reduce component costs.

It is to be noted that the embodiments and the example of variation as described above merely illustrate configurations which are representative for the present invention, and that the present invention is not limited to these embodiments.

This means that various modifications may be implemented and used within a scope which does not depart from the core of the present invention. It is to be understood that such modifications are also included in the scope of the present invention as long as they include the features of the inventive core wire deformation jig and method.

For example, according to the embodiments and example of variation as described above, the multi-core cable 2 with two core wires 21 is illustrated as an element to be deformed. However, multi-core cables which are to be deformed are not limited to two-core cables, but any number of core wires can be used as long as more than one of core wire is used. Furthermore, in this case, a number of separation pins which corresponds to the number of core wires is to be provided for inserting between the core wires.

Moreover, the embodiments and example of variation as described above do not mention a method for attaching the first clamping unit 110, 310 and the third clamping unit 140. The attachment of these units can be performed mechanically using an actuator in a similar manner to the insertion and movement of the separation pin 120 or the movement of the second clamping unit 130, or by an operating person in a manual manner.

REFERENCE SIGN LIST

1, 3 core wire deformation jig
2 multi-core cable
21 core wires
21*a* exposed portions
110, 310 first clamping units
111 upper clamping portion
112 lower clamping portions
120 separation pin
130, 330 second clamping unit
131, 331 left and right clamping portions
140 third clamping unit
150 second clamping unit actuating mechanism
160 separation pin actuating mechanism
170 cable table
211 tip side portions
212 root sides
D11 first clamping direction
D12, D32 insertion directions
D13 second clamping direction
D14 movement direction
P11 arranging plane
d11 distance

What is claimed is:

1. A core wire deformation jig for providing bends to a plurality of adjacent core wires which are exposed from an end of a multi-core cable so that tip side portions of the adjacent core wires are spaced and aligned on a predetermined arranging plane, the bends with the adjacent core wires being spread out starting from root sides of their exposed portions to the tip side portions, the core wire deformation jig comprising:

a first clamping unit for clamping the plurality of adjacent core wires aligned on the arranging plane in a first clamping direction intersecting the arranging plane;

a separation pin for separating the adjacent core wires from each other, the separation pin being provided moveably in an insertion direction parallel to the first clamping direction so as to be insertable between the adjacent core wires clamped by the first clamping unit to move the adjacent core wires apart from each other;

a second clamping unit for providing the bends to the core wires by clamping the plurality of core wires, with the separation pin disposed between the adjacent core wires, in a second clamping direction parallel to the arranging plane and intersecting the adjacent core wires and applying a pressure on the adjacent core wires; and a third clamping unit for clamping the root sides of the exposed portions of the adjacent core wires in tight contact with each other in the second clamping direction.

2. The core wire deformation jig according to claim 1, wherein the separation pin is further provided movably in a movement direction parallel to the arranging plane and intersecting the second clamping direction; and wherein the core wire deformation jig comprises a separation pin actuating mechanism which inserts the separation pin between the adjacent core wires at a location far spaced from the root sides of the exposed portions and moves the pin after the insertion toward the root sides of the exposed portions.

3. The core wire deformation jig according to claim 1, wherein the first clamping unit comprises a pair of clamping portions configured to be arranged interposing the arranging plane between them; and wherein the second clamping unit also serves as one of the pair of clamping portions of the first clamping unit.

4. A core wire deformation jig for providing bends to a plurality of adjacent core wires which are exposed from an end of a multi-core cable so that tip side portions of the adjacent core wires are spaced and aligned on a predetermined arranging plane, the bends with the adjacent core wires being spread out starting from root sides of their exposed portions to the tip side portions, the core wire deformation jig comprising:

a first clamping unit for clamping the plurality of adjacent core wires aligned on the arranging plane in a first clamping direction intersecting the arranging plane;

a separation pin for separating the adjacent core wires from each other, the separation pin being provided moveably in an insertion direction parallel to the first clamping direction so as to be insertable between the adjacent core wires clamped by the first clamping unit to move the adjacent core wires apart from each other; and a second clamping unit for providing the bends to the core wires by clamping the plurality of core wires, with the separation pin disposed between the adjacent core wires, in a second clamping direction parallel to the arranging plane and intersecting the adjacent core wires and applying a pressure on the adjacent core wires;

wherein the first clamping unit comprises a pair of clamping portions configured to be arranged interposing the arranging plane between them; and wherein the second clamping unit also serves as one of the pair of clamping portions of the first clamping unit.

5. The core wire deformation jig according to claim 2, wherein the first clamping unit comprises a pair of clamping portions configured to be arranged interposing the arranging plane between them; and wherein the second clamping unit also serves as one of the pair of clamping portions of the first clamping unit.

6. A core wire deformation method for providing bends to a plurality of adjacent core wires which is exposed from an end of a multi-core cable so that tip side portions of the core wires are spaced and aligned on a predetermined arranging plane, the bends with the adjacent core wires being spread out starting from root sides of their exposed portions to the tip side portions, the core wire deformation method comprising:

a first clamping step for clamping with a first clamping unit the adjacent core wires aligned on the arranging plane in a first clamping direction intersecting the arranging plane;

a separation step for separating the adjacent core wires from each other, the separation pin being inserted between the adjacent core wires clamped with the first clamping unit in an insertion direction parallel to the first clamping direction to move the adjacent core wires apart from each other; and a second clamping step for providing the bends to the adjacent of core wires by clamping the adjacent core wires with a second clamping unit, with the separation pin disposed between the adjacent core wires, in a second clamping direction parallel to the arranging plane and intersecting the adjacent core wires and applying a pressure on the core wires wherein the root sides of the exposed portions of the adjacent core wires are clamped in the second clamping direction in tight contact with each other by a third clamping unit, and wherein the separation pin is inserted between the adjacent core wires on a side closer to tip sides of the adjacent core wires than the root sides, while the root sides are clamped by the third clamping unit.

* * * * *